United States Patent [19]

Koudstaal et al.

[11] Patent Number: 4,806,021

[45] Date of Patent: Feb. 21, 1989

[54] CONTAINER FOR DRINK AND METHOD OF MANUFACTURING THE CONTAINER

[75] Inventors: Willem Koudstaal, Vinkeveen, Netherlands; Alan Thomas, Woking; Jeffrey L. Lewis, Farnham, both of United Kingdom

[73] Assignee: Koninklijke Emballage Industrie Van Leer B.V., Amstelveen, Netherlands

[21] Appl. No.: 107,913

[22] Filed: Oct. 15, 1987

Related U.S. Application Data

[63] Continuation of Ser. No. 901,436, Aug. 28, 1986, abandoned.

[30] Foreign Application Priority Data

Aug. 28, 1985 [NL] Netherlands ..... 8502366

[51] Int. Cl.[4] ..... B65D 30/22

[52] U.S. Cl. ..... 383/40; 383/906; 229/103.1; 206/217

[58] Field of Search ..... 206/217; 229/103.1, 229/906.1, 65 C; 383/38, 39, 40, 906; 220/85 B, 90.2

[56] References Cited

U.S. PATENT DOCUMENTS

| | | | |
|---|---|---|---|
| 2,220,746 | 11/1940 | Wentz | 229/7.5 |
| 2,617,559 | 11/1952 | Van Der Spek . | |
| 2,689,076 | 9/1954 | Jenkins . | |
| 2,849,321 | 8/1958 | Lhermitte et al. . | |
| 2,992,118 | 7/1961 | Daline . | |
| 2,996,239 | 8/1961 | Lennartz . | |
| 3,144,976 | 8/1964 | Freshour . | |
| 3,171,581 | 3/1965 | Kugler . | |
| 3,217,934 | 11/1965 | Schneider et al. | 383/40 |
| 3,224,640 | 12/1965 | Schneider et al. | 383/40 |
| 3,545,604 | 12/1970 | Gunther, Jr. . | |
| 3,679,093 | 7/1972 | Chang . | |
| 3,730,336 | 5/1973 | Feldman . | |
| 3,874,554 | 4/1975 | Chang | 229/103.1 |
| 4,194,674 | 3/1980 | Pearson . | |
| 4,411,359 | 10/1983 | Franco . | |
| 4,512,472 | 4/1985 | Jarund . | |
| 4,553,693 | 11/1985 | Terajima et al. | 229/103.1 |
| 4,591,091 | 5/1986 | Wise . | |
| 4,602,714 | 7/1986 | Ozeki | 206/455 |
| 4,629,070 | 12/1986 | Roberg | 206/455 |

FOREIGN PATENT DOCUMENTS

| | | |
|---|---|---|
| 106648 | 10/1983 | European Pat. Off. . |
| 1264666 | 5/1961 | France . |
| 2452440 | 11/1980 | France . |
| 72735 | 4/1970 | German Democratic Rep. . |
| 196874 | 9/1964 | Sweden . |
| 723588 | 7/1953 | United Kingdom . |

*Primary Examiner*—David T. Fidei
*Attorney, Agent, or Firm*—Brumbaugh, Graves Donohue & Raymond

[57] ABSTRACT

A container for a drink comprised of a bag of flexible plastic material for drink compacting sheets (1,2) welded upon each other by means of spaced longitudinal and transverse seams (3,4,5 and 6) which bag by means of a strip (7) or sheet (23) has been provided with a space for the insertion of a straw (13) such that the welding seams of said strip (7) or sheet (23) are either at a distance from the seams of the bag or coincide with said seams, an opening being provided for the insertion of the straw. The straw is movable within the space for puncturing the inside wall of the space which is elastically deformable and elastically surrounds the outer perimeter of the straw after it has punctured the wall. The straw may be removed if the contents of the bag are only partially consumed, thereby forming a seal by the punctured wall pushing against the outside wall of the space under pressure from the contents therein.

The invention also deals with a method for manufacturing the bag by guiding a third sheet (23) into the path of the bag forming sheets (1,2).

4 Claims, 3 Drawing Sheets

CONTAINER FOR DRINK AND METHOD OF MANUFACTURING THE CONTAINER

This application is a continuation of application Ser. No. 910,436, filed on 8/28/86, now abandoned.

BACKGROUND OF THE INVENTION

The invention relates to a container for drink consisting of a bag of flexible thermoplastic plastic material, which bag is closed by a means of longitudinal and transverse seams and is provided with a part welded on in a manner such that a space is obtained into which a small straw can be inserted.

A container of this type is known, for example, from the British Pat. No. 723,588. In this known container the part which defines the space into which a straw can be inserted consists of a sleeve which is open at the end facing the interior of the bag and forms a valve at that point which is closed by the pressure of the liquid because the wall parts of the sleeve are pressed against each other. The sleeve is secured by welding into one of the longitudinal seams of the bag and has a section projecting outwards which can be sealed by folding. If this end is opened, then a small straw can be inserted into the sleeve, as a result of which the latter loses its valve function and opens up so that the contents can be consumed.

This known container has the drawback that the valve is not always adequately sealed and that the manufacture is complicated. At the point where the sleeve extends through the transverse seam, the number of layers welded onto each other is locally doubled, which often gives rise to a poor weld as a result of which leakage may occur. In addition, the small straw is a loose component which has to be supplied separately.

SUMMARY OF THE INVENTION

The object of the invention is to provide a container in which said drawbacks no longer occur.

This object is achieved according to the invention in the first place in that the space for the inserting therein of the small straw is exclusively defined by welding seams between a bag wall and a part defining the space, which welding seams are situated inside the longitudinal and transverse seams of the bag and leave the layer thickness at the position of said longitudinal and transverse seams of the bag unchanged, and the bag has an opening inside the region, defined by the longitudinal and transverse seams of the bag, at the position of the said space, through which opening a small straw can be inserted or has been inserted. According to the invention the space for the inserting therein of the small straw therefore now has only an insertion opening in which a small straw can be placed but the space itself is closed. The valve function therefore no longer exists. If it is desired to consume the contents of the container, the wall has to be punctured by means of the small straw, an operation which is otherwise known in the case of containers with small straws supplied loose. Because the space is normally closed and has only an insertion opening, the small straw may already have been placed in the insertion opening before the container is delivered. The small straw is therefore no longer a loose component, or at least does not have to be one.

The welding seams which define the insertion space for the small straw leave the layer thickness at the position of the longitudinal or transverse seams of the bag undisturbed, as a result of which the risk of leakage is avoided.

According to the invention, the surface of the space facing the interior of the bag is preferably formed with an elastically deformable film, and the small straw is obliquely cut off at an acute angle such that the small straw expands the opening elastically after perforation of the wall. This is achieved is a simple manner by cutting off a small screw of adequate strength at an acute angle of, for example, 45°. The film can be perforated with the sharp point which has been formed on the small straw in this manner, after which this perforation can be expanded by the small straw. This has the result that the film surrounds the small straw so as to form a seal. No leakage can therefore occur along the outside wall of the small straw during the consumption of the contents or if a portion of the content is still being kept.

According to the invention the space may be defined by a strip welded onto one wall of the bag. This strip may have a width or length which is equal to the width or length respectively of the bag wall. The welding seams then coincide, which means that the welding seams which define the bag, contain three layers over the entire length. This strip may be situated on the inside or on the outside.

The longitudinal or transverse seams of the strip may also be situated at a distance from the welding seams which define the bag.

It is also conceivable that the space is defined by a sleeve welded onto the inside surface of the bag and the top edges of which are are attached by welding to a wall of the bag in a manner such that they surround the opening for the small straw.

Moreover, if a strip is used which is equally as large as a side wall of the bag, it is desirable, moreover, also to provide additional welding seams between the strip and a bag wall in order to define and reduce the space for the small straw. Said seams may, for example, consist of a longitudinal seam which extends from the top transverse seam of the bag to a transverse seam and of a transverse seam which defines the bottom of the space and which terminates at the position of a longitudinal seam.

The invention also relates to a method for making a bag according to the invention in which two sheets of thermoplastic plastic material are brought up against each other and bags are formed by means of welding seams, in which process, according to the invention, a third sheet is then brought up against one of the sheets defining the bag wall and is secured thereto by welding to form the said space before or during the welding of the bag seams, the sheet which defines the outside wall of the space is provided before welding with insertion openings at distances from each other which coincide with the pitch distance of the bags, said openings are opened after welding the sheets defining the space to each other and a small straw is inserted into each of said opened openings in step with the advance of the sheets.

According to the invention, therefore, the third sheet is welded onto one of the two sheets before the bags are formed in order to form the insertion space, or the three sheets are welded to each other simultaneously.

If the third sheet is applied to the outside of a bag wall, said third sheet should be provided with the insertion opening for the small straw. However, if the third sheet is applied to the inside of a sheet of film defining a bag wall, said sheet of film determining a bag wall should be provided with the insertion opening for the small straw. The opening of the insertion opening can be performed in an easy manner with nozzles, after which small straws can be inserted into the openings from the top, for example by means of a device which operates in step, which feeds the small straws and inserts them into the openings by means of a transverse stroke.

The invention thus now provides the possibility of providing a container for drink which is already provided with a small straw, is easy to manufacture and presents no leakage problems.

BRIEF DESCRIPTION OF THE DRAWINGS

The invention will now be explained in more detail by reference to the drawings.

FIG. 9 shows diagrammatically in perspective a device for applying the method for the manufacture of the container according to the invention.

DETAILED DESCRIPTION OF THE PREFERRED EMBODIMENTS

Figure 1:
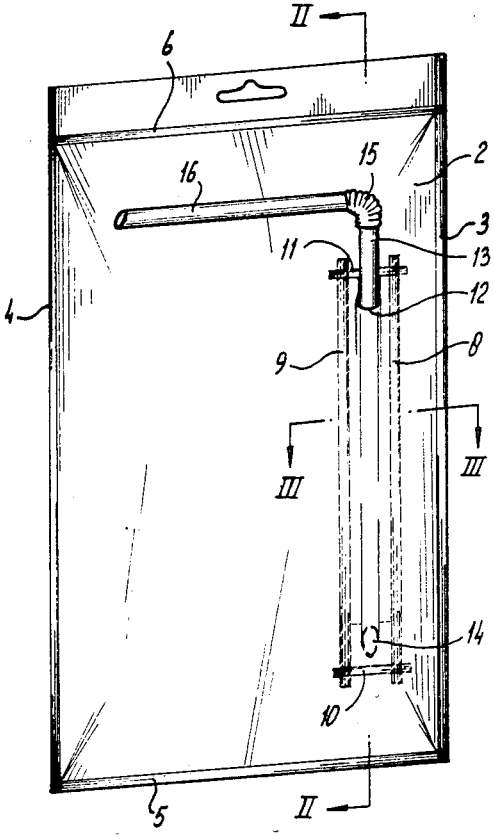
FIG. 1 is a front view of a container according to the invention.

The container shown in the drawings consists of two films 1 and 2 respectively in the form of sheets of film which are formed by vertical welding seams 3 and 4 respectively and a horizontal bottom seam 5 into bags which are closed after filling by means of the top welding seam 6.

Before the films 1 and 2 are welded to each other by means of the vertical seams 3 and 4 respectively, a strip 7 is attached by welding by means of the vertical welding seams 8 and 9 and the horizontal welding seams 10 and 11 to the inside surface of the film 2 or to the outside surface of said film.

Before this an opening is punched in the film 2 at 12 for the insertion therein of a small straw 13 which is provided with a sharp point 14 and preferably consists of the type which has a pleated bent section 15 so that the end 16 can be laid flat against the side wall of the container. A bag of this type is completely closed. If it is desired to consume the contents, the small straw is thrust through the bottom section 17 of the welded-in strip 7 by means of the sharp point.

If the strip 7 is welded onto the outside of the sheet of film 2 the strip 7 should be provided with an insertion opening and the sharp point of the small straw must be pressed through the sheet of film 2, i.e. through the wall of the container.

If the contents are only partially consumed, the container can conceivably be sealed by pulling the small straw back, in which case the pressure of the contents will press the strip 7 against the inside wall 2. A valve action is then produced such as is known per se in the container according to the British Pat. No. 723,588 mentioned earlier.

It is, however, of greater benefit to take for the wall to be pierced a material which is elastically deformable such as, for example, a low-pressure polyethylene. With a sufficiently robust small straw and a point cut off obliquely, for example cut off at 45°, the point of the small straw will pierce the film material, after which the hole formed is elastically expanded and forms a seal around the small straw. Leakage along the outside wall of the small straw is not then possible, which is of benefit both during the consumption of the contents and if a portion of the contents is being kept.

Figure 2:
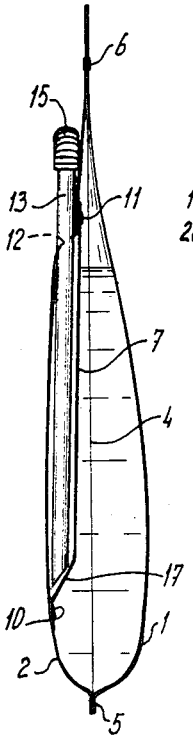
FIG. 2 is a section along the line II—II of FIG. 1.
Figure 3:
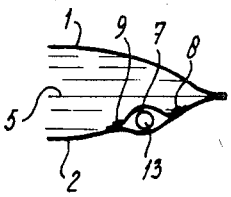
FIG. 3 is a section along the line III—III of FIG. 1.

Whereas in the embodiment of the FIGS. 1, 2 and 3, the strip has welding seams 8 to 11 incl. which are clearly situated at a distance from the welding seams 3 to 6 incl. of the container, it is, of course, also possible to apply welding seams in a different manner without this resulting in a change of the layer thickness at the position of the welding seams 3 to 6 incl. of the container.

Possibilities of this type are shown in the FIGS. 4 to 7 incl.

Figure 4:
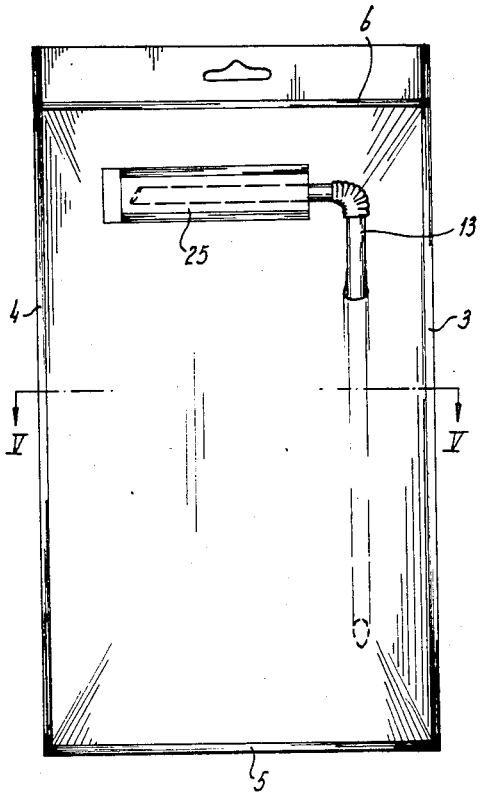
FIG. 4 is a front view of another embodiment of the container according to the invention.
Figure 5:
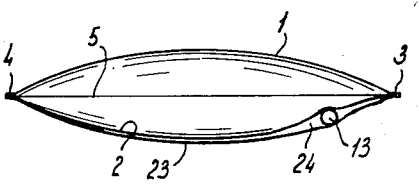
FIG. 5 is a section along the line V—V of FIG. 4.

In the embodiment of FIGS. 4 and 5, the starting point is sheets of film of the same width. To the sheets of film 1 and 2 is added a third sheet of film 23 which defines the space 24 for the small straw 13. There are therefore now no separate welding seams, but the welding seams 3, 4, 5 and 6 comprise three layers instead of two layers. Over the entire length of each welding seam, however, the number of layers remains constant.

In this embodiment the small straw 13 is secured to the outside wall of the container by means of an adhesive strip 25 which can be pulled off. This adhesive strip can be used in any embodiment.

Figure 6:
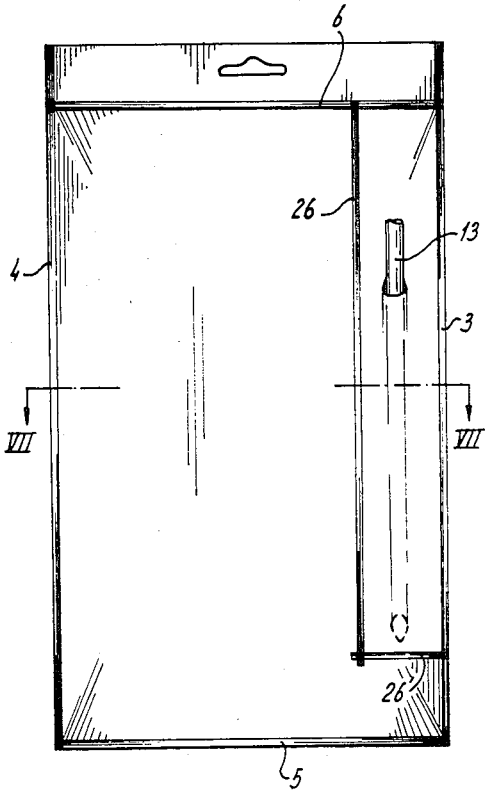
FIG. 6 is a front view of yet another embodiment of the container according to the invention.
Figure 7:
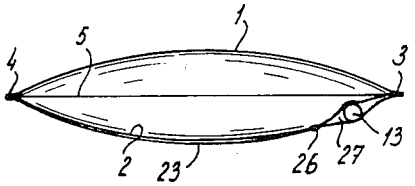
FIG. 7 is a Section along the line VII—VII of FIG. 6.
Figure 5:
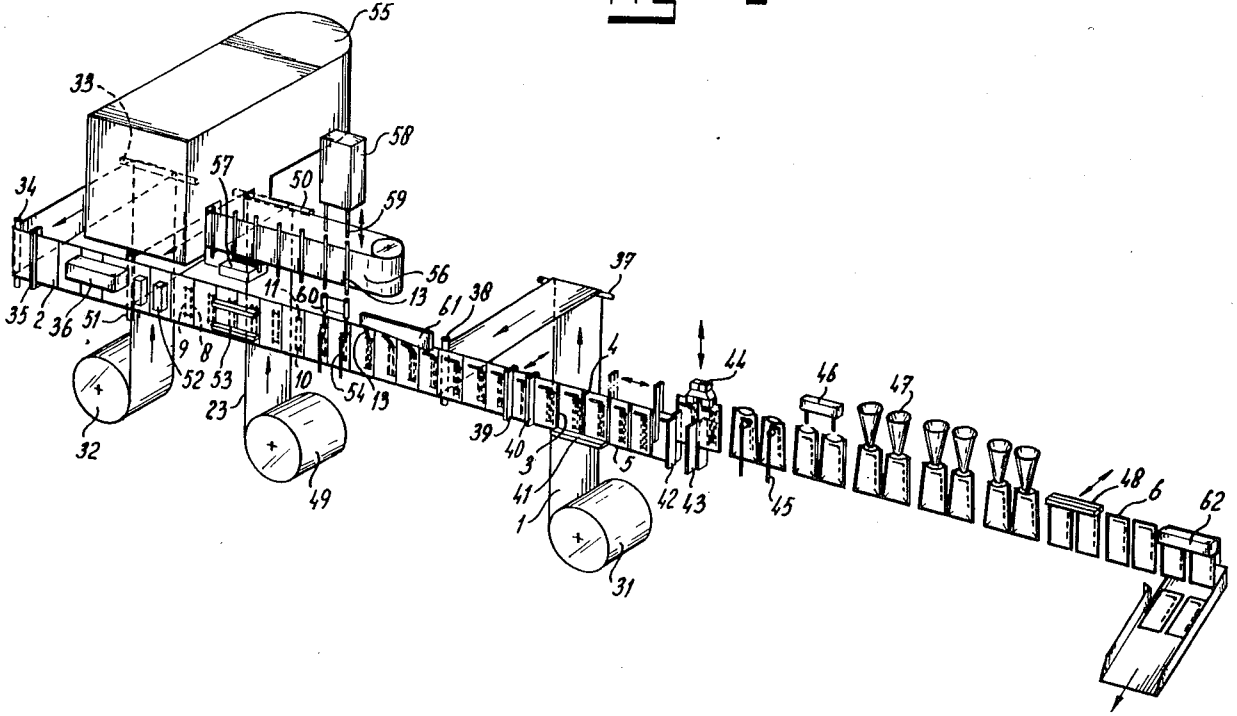

The embodiment according to FIGS. 6 and 7 differs from that according to FIGS. 4 and 5 in that the third film 23, in addition to being secured by welding to the sheet of film 2 at the position of the welding seams 3 to 6 incl., is secured by welding by means of a vertical seam 26 and a horizontal seam 26', as a result of which a small space 27 is isolated from the large space 24 to accommodate the small straw. The welding seams 26 and 26' comprise two layers and adjoin the welding seams 6 and 3 respectively consisting of three layers without, however, having an effect on the layer thickness.

Figure 8:
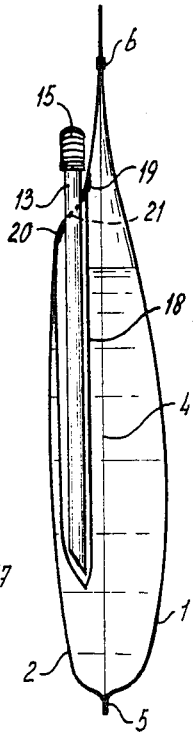
FIG. 8 is a vertical section through yet another variant of the container according to the invention.

The embodiment of FIG. 8 differs from that of the preceding figures in that the small straw 13 is situated in a sleeve 18 which is welded by means of the upper edges at 19 and 20 respectively around the opening 21 of the sheet of film 2. In this embodiment the insertion space for the small straw is also formed in a manner such that the layer thickness at the longitudinal seams remains unchanged. However, the manufacture of this embodiment is somewhat more complicated.

The method of manufacture of the containers according to FIGS. 1 to 7 incl. is explained by reference to FIG. 9.

This figure shows a supply reel 32 for the sheet of film 2 which passes over the deflecting rollers 33 and 34 and through a guide 35 so that the sheet of film 2 is guided accurately in a vertical plane.

At 36 a device is located for punching the insertion openings for small straws.

At 31 is located the supply reel for the sheet of film 1 which is guided over the deflecting rollers 37 and 38, as a result of which the two sheets of film 1 and 2 end up alongside each other.

At 39 and 40 are situated the welding devices for making the vertical welding seams 3 and 4.

At 41 is situated the welding device for making the bottom transverse seam 5.

At 42 and 43 are located cutting knives by means of which the still open empty containers are separated from each other and are passed by means of a transfer device 44 to a filling station where the containers are opened with suction nozzles 45, are flushed with a gas at 46 and then pass through the filling stations 47, after which the top transverse seam 6 is made at 48.

Before the two sheets of film 1 and 2 are brought up against each other at the deflection roller 38, a third sheet of film 23 is brought up against the sheet of film 2 from a supply reel 49 via the deflecting rollers 50 and 51. The vertical welding seams 8 and 9 are then made between the sheets of foil 2 and 23 by means of the welding devices 52 and the horizontal welding seams 10 and 11 with the welding devices 53.

The space is then opened with the vacuum devices 54 so that the small straws 13 can be inserted into the openings 12.

Said small straws are fed from a stock container 55 by means of a conveyor belt 56 which carries the small straws at regular distances from each other. The small straws may be secured, for example, by friction in sheaths or clips present in the belt 56. At 57 is situated the device for cutting off the bottom end of the small straws obliquely. At 58 is situated a device which has pushing elements 59 which can perform a vertical stroke and insert the small straws 13 into an opening 12 via the guide 60.

The small straws are then folded over by means of the device 61 and at 62, at the end of the complete operation, are provided with the adhesive strip 25 shown in FIG. 4.

The device shown in FIG. 9 refers in particular to the embodiments of FIGS. 1 to 3 incl.

For the embodiments of FIGS. 4 and 5 the welding devices 52 and 53 can be omitted. The welding then takes place exclusively by means of welding devices 39 and 41 and the means for opening the openings 12 and the means for inserting the small straws are situated downstream of the welding devices 39, 40 and 41.

In the embodiments of FIGS. 6 and 7 the welding seams 26 and 26' are first applied with welding devices comparable to the welding devices 52 and 53 and the feed device for the small straws should be situated downstream of the welding devices 39, 40 and 41.

We claim:

1. A container for a drink comprising a bag of tear-resistant flexible thermoplastic first material for housing the drink contents therein formed by welding two parallel sheets of said material at top, bottom and opposite side edge seams, one of said parallel sheets forming said bag having a space for housing a straw, said space formed from a third sheet of elastically deformable second material welded upon the inside of said one of said parallel sheets by means of two spaced apart parallel longitudinal seams and two spaced apart parallel transverse seams in such a manner that the layer thickness of said seams defining the bag remains constant over the entire length thereof and such that said straw can move only in a longitudinal direction therein, an outer wall of said space having an opening open towards the outside of said bag to allows a first free end of said straw to remain permanently outside said space and to further allow said straw to move only in the longitudinal direction such that said straw can be urged to puncture an elastically deformable inner wall of said space with a second sharpened end thereof, said inner wall of said space elastically enclosing the outer perimeter of said straw after the sharpened end of said straw has punctured said inner wall of said space for removal of the enclosed drink contents.

2. A container according to claim 1, wherein said third sheet is a strip welded upon the inner side of said one of said parallel sheets, said strip having a length and width which are smaller than said seams defining said bag.

3. A container according to claim 1, wherein said inner third sheet has the same length and width as said sheets defining said bag, such that said longitudinal and transverse seams of said third sheet are coincidental with said seams defining said bag.

4. A container according to claim 3, further comprising a third longitudinal seam and a third transverse seam, said third seams welding said third sheet upon said one of said parallel sheets, said third longitudinal seam parallel to and between said first two longitudinal seams, said third transverse seam parallel to and between said first two transverse seams and extending from one of said first two longitudinal seams to at least said third longitudinal seam.

* * * * *

UNITED STATES PATENT AND TRADEMARK OFFICE

CERTIFICATE OF CORRECTION

PATENT NO. : 4,806,021

DATED : February 21, 1989

INVENTOR(S) : Koudstaal et al.

It is certified that error appears in the above-identified patent and that said Letters Patent is hereby corrected as shown below:

Column 2, line 8, "is a" should be --in a--;

Column 2, line 9, "screw" should be --straw--; and

Column 6, line 19, "allows" should be --allow--.

Signed and Sealed this

Twenty-sixth Day of September, 1989

*Attest:*

DONALD J. QUIGG

*Attesting Officer*

*Commissioner of Patents and Trademarks*